United States Patent [19]

Kronlokken et al.

[11] 3,933,260

[45] Jan. 20, 1976

[54] HOIST SYSTEM FOR POWER SHOVELS

[75] Inventors: Loren Kronlokken, Edina, Minn.; Guenter Fritz Lehmann, Marion, Ohio

[73] Assignee: Marion Power Shovel Co., Inc., Marion, Ohio

[22] Filed: Sept. 14, 1973

[21] Appl. No.: 397,586

[52] U.S. Cl. ..... 214/138 R; 214/135 R

[51] Int. Cl.[2] ..... B66C 3/02

[58] Field of Search ..... 214/137, 138, 136, 135 A, 214/135 R; 212/9, 8 R

[56] References Cited

UNITED STATES PATENTS

| | | | |
|---|---|---|---|
| 2,084,449 | 6/1937 | Neese | 214/135 R |
| 2,498,000 | 2/1950 | McLean | 214/138 R |
| 2,985,326 | 5/1961 | Lowell | 214/135 R |
| 3,346,129 | 10/1967 | Carter et al. | 214/135 R |
| 3,403,940 | 10/1968 | Clark | 214/138 R |
| 3,436,849 | 4/1969 | Haynes | 214/138 R |

*Primary Examiner*—Robert J. Spar
*Assistant Examiner*—Kenneth Noland
*Attorney, Agent, or Firm*—Mason, Fenwick & Lawrence

[57] ABSTRACT

A hoist system for a power shovel having a main frame, a boom connected at a lower end thereof to the main frame, a dipper handle pivotally connected to the boom and a dipper pivotally connected to the dipper handle, including means for varying the pitch of the dipper, generally including a hoist mechanism mounted on the main frame, a first hoist line operatively connected at one end thereof to the hoist mechanism, passing over a point on the boom and operatively connected at the opposite end thereof to the dipper handle, a second hoist line operatively connected at one end thereof to the hoist mechanism, passing over a point on the boom and operatively connected at the opposite end thereof to the dipper, and means for selectively varying the effective length of one of said hoist lines relative to the other thereof.

30 Claims, 7 Drawing Figures

HOIST SYSTEM FOR POWER SHOVELS

This invention relates to power shovels and more particularly to a hoist system for a power shovel having a main frame, a boom connected at a lower end thereof to the main frame, a dipper handle pivotally connected to the boom and a dipper pivotally connected to the dipper handle, which includes means for varying the pitch of the dipper.

A common type of power shovel in the prior art generally has consisted of a crawler assembly, a main frame rotatably mounted on the crawler assembly, a boom connected at its lower end to the main frame, a gantry mounted on the main frame, pendants interconnecting the boom with the gantry for maintaining the boom at a predetermined angle, a dipper handle mounted on the boom for reciprocable and pivotal movement, a dipper pivotally connected to the end of the dipper handle, a mechanism for crowding and retracting the dipper handle, and a hoist line connected to the dipper, which normally passes around a sheave mounted at the point of the boom and is operatively connected to a hoist mechanism mounted on the main frame.

In the normal operation of such a power shovel during a digging cycle, initially, the dipper handle is fully retracted and the hoist line is payed out to position the dipper adjacent the main frame of the machine. The dipper handle then is extended by the crowd mechanism to crowd the dipper into the material being excavated and the hoist line is taken in either simultaneously or sequentially with the extension of the dipper handle to fill the dipper and hoist it to a dump position. Under such general conditions, the dipper moves in an arcuate line of travel which often is undesirable, particularly the excavation of thin seams of ore where a maximum horizontal movement of the dipper is most beneficial in obtaining a optimum fill of the dipper.

To provide an elongated horizontal crowding movement of the dipper in the digging cycle of the machine as described, or to effect penetration of difficult to handle material, necessitates a pitch adjustment of the dipper of such machines. In the prior art, various arrangements have been provided to adjust the pitch of the dipper during the digging cycle of the machine which primarily have consisted of the use of powered actuators operatively interconnecting either directly or through the use of various linkage arrangements, the outer end of the dipper handle and the dipper. Such arrangements, however, have been found not to be entirely satisfactory in that the vulnerability of such mechanisms to damage and failure, and the degree of reliability required thereof has necessitated the design of heavy components or the use of protective components which correspondingly adversely affects the payload of the machine. It thus has been found desirable to provide an improved means for varying the pitch of a dipper in a machine of the type described without adversely affecting the payload of the machine.

Accordingly, it is the principle object of the present invention to provide an improved means for effecting a pitch change of the dipper of a power shovel.

Another object of the present invention is to provide an improved means for effecting a pitch change of the dipper of a power shovel which will not adversely affect the payload of the shovel.

A further object of the present invention is to provide an improved means for effecting a pitch change of the dipper of a power shovel which is not vulnerable to damage and failure.

A still further object of the present invention is to provide an improved means for effecting a pitch change of the dipper of a power shovel in which a minimum number of components utilized to effect such pitch change, are located on the end of the dipper handle.

Another object of the invention is to provide an improved means for effecting a pitch change of the dipper of a power shovel which is comparatively simple in construction, relatively inexpensive to manufacture, install and maintain, and highly reliable in performance.

A further object of the present invention is to provide a novel hoist system for a power shovel having a boom, a dipper handle reciprocably and pivotally mounted on the boom and a dipper pivotally connected to the end of the dipper handle including means for controlling the pitch of the dipper.

A still further object of the present invention is to provide an improved hoist system for a power shovel including means for adjusting the pitch of the dipper at optimum angles during a digging cycle to facilitate the penetration of the dipper into the material being excavated and optimize the amount of material removed by the dipper.

Another object of the present invention is to provide a novel hoist system for the dipper of a power shovel including means for controlling the pitch of the dipper during the digging cycle thereof which is operable to maintain the digging teeth of a dipper substantially horizontal while the dipper is being crowded, and pitch the dipper upwardly at the end of the crowding phases of the digging cycle and the hoisting thereof, thus assuring an optimum fill of the dipper.

Another object of the present invention is to provide an improved hoist system for the dipper of a power shovel including means for effecting a pitch change of the dipper at any point of the digging cycle which is comparatively simple in construction, relatively inexpensive to manufacture, install and maintain, and highly reliable in performance.

Other objects and advantages of the present invention will become more apparent to those persons having ordinary skill in the art to which the invention pertains, from the following description taken in conjunction with the accompanying drawings wherein.

Figure 1:
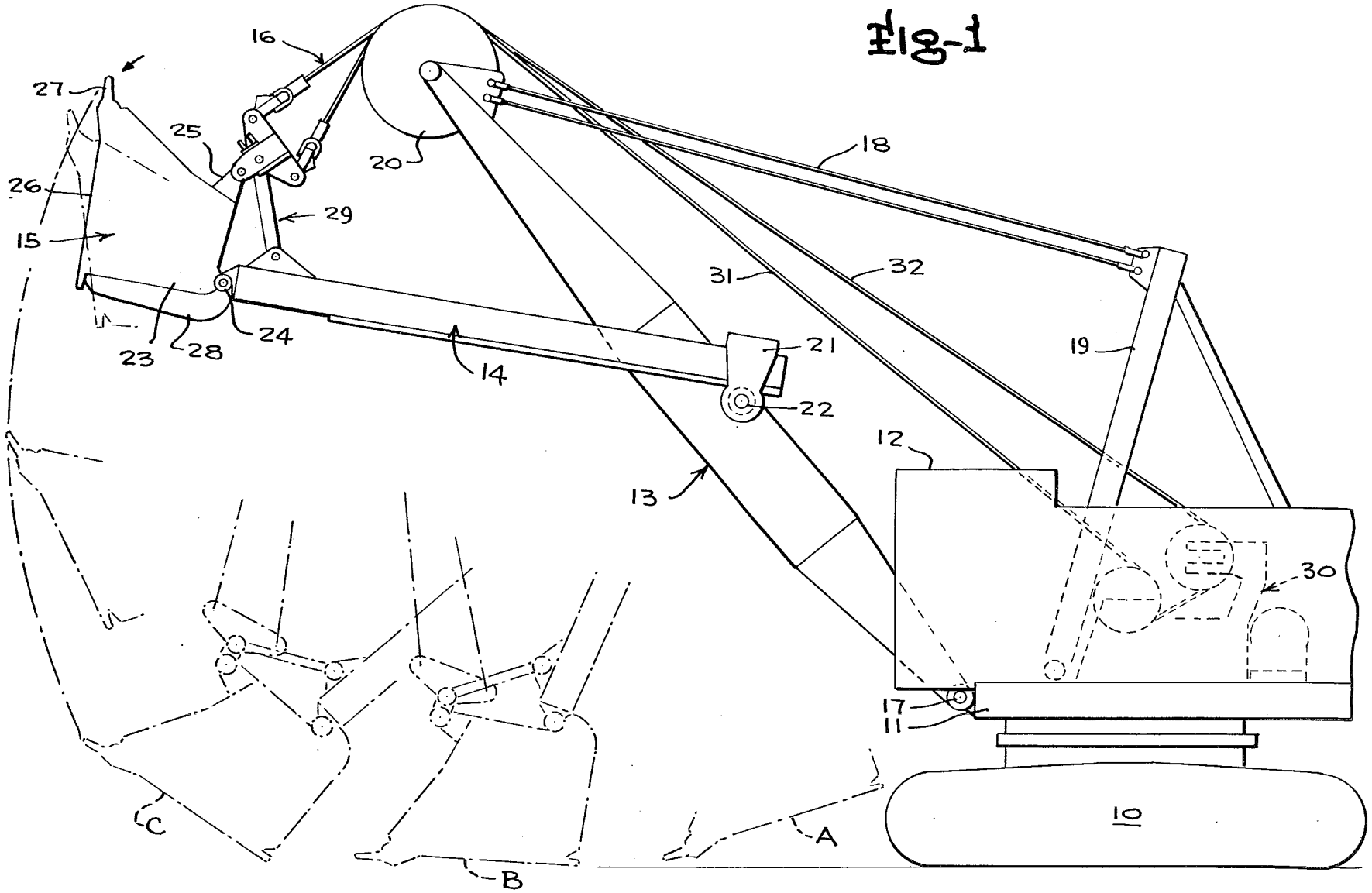
FIG. 1 is a side elevational view of a power shovel utilizing an embodiment of the invention.

Briefly described, the present invention relates to a hoist system for a power shovel having a main frame, a boom connected at a lower end thereof to the main frame, a dipper handle reciprocably and pivotally connected to the boom and a dipper pivotally connected to the dipper handle, including means for varying the pitch of the dipper, generally including hoist mechanism mounted on the main frame, a first hoist line operatively connected at one end thereof to the hoist mechanism passing over a point on the boom and operatively connected at the opposite end thereof to the dipper handle, a second hoist line operatively connected at one end thereof to the hoist drum, passing over a point on the boom and operatively connected at the opposite end thereof to the dipper, and means for selectively varying the effective length of one of the hoist lines relative to the other thereof.

In a more specific embodiment of the invention, there is provided a support link pivotally connected to the dipper handle, a pivot link pivotally connected to the dipper and pivotally connected to the support link at a point spaced from the pivotal connection thereof with the dipper to form a four-bar linkage including a portion of the dipper handle, a portion of the dipper and the support and pivot links, and the hoist ropes are connected to the pivot link on opposite sides of a line intersecting the point on the boom and the pivotal connection between the support and pivot links. Furthermore, in such embodiment, the means for selectively varying the effective length of one of the hoist lines relative to the other thereof consists of a floating sheave about which one of the hoist lines is reeved and means for moving such floating sheave along a line of travel intersecting such hoist line.

Referring to the drawings, there is illustrated a preferred embodiment of the invention. Specifically referring to FIG. 1, there is illustrated a crawler unit 10 supporting a lower frame provided with a roller circle, a main or upper frame 11 rotatably mounted on the roller circle of the crawler unit, a cab 12 mounted on the main frame, a boom 13, a dipper handle 14 provided with a dipper 15 and a hoist system 16. In the conventional manner, the boom 13 is connected at its lower end to the front end of the main frame by means of foot pins 17 and is maintained at a fixed angle by means of pendants 18 interconnecting the upper end of the boom and the upper end of a gantry 19 mounted on the main frame. The point of the boom is provided with a pair of coaxially disposed sheaves 20 which cooperate with the hoist system as will be described later. The dipper handle 14 is reciprocably mounted in a conventional saddle block 21 which is pivotally connected to the boom intermediate the ends thereof by means of a shaft 22. The extension of the dipper handle to crowd the dipper and the retraction thereof during a normal digging cycle is effected by a conventional mechanism mounted on the boom and the main frame, and operatively connected to the dipper handle. The dipper 15 also is substantially of conventional construction including a pair of side walls 23 pivotally connected adjacent the rear ends thereof to the outer end of the dipper handle 14 by means of pivot pins 24 and having forwardly projecting brackets 25, a bottom wall 26 having forwardly projecting digging teeth 27 mounted on the front edge thereof, and a rearwardly disposed, hinged door 28 normally latched in the closed position.

Figure 3:
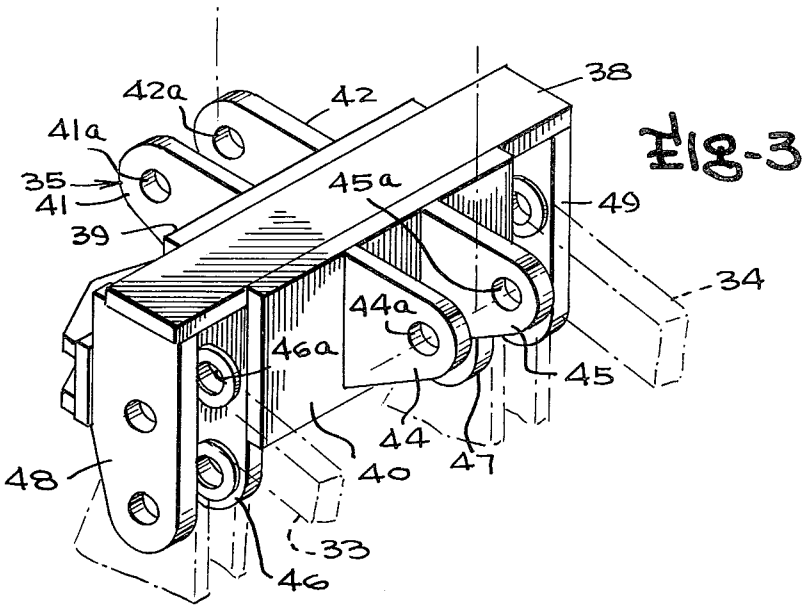
FIG. 3 is an enlarged perspective view of a component of the embodiment of the invention illustrated in FIGS. 1 and 2.
Figure 4:
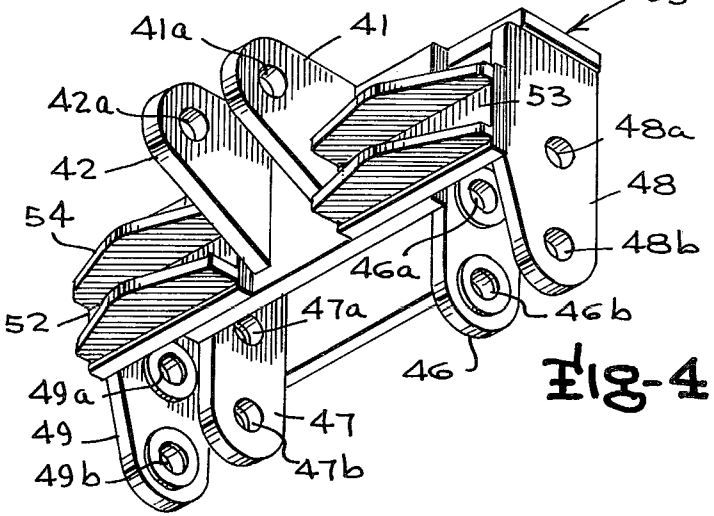
FIG. 4 is a perspective view of the component shown in FIG. 3, illustrating an opposite side thereof.
Figure 2:
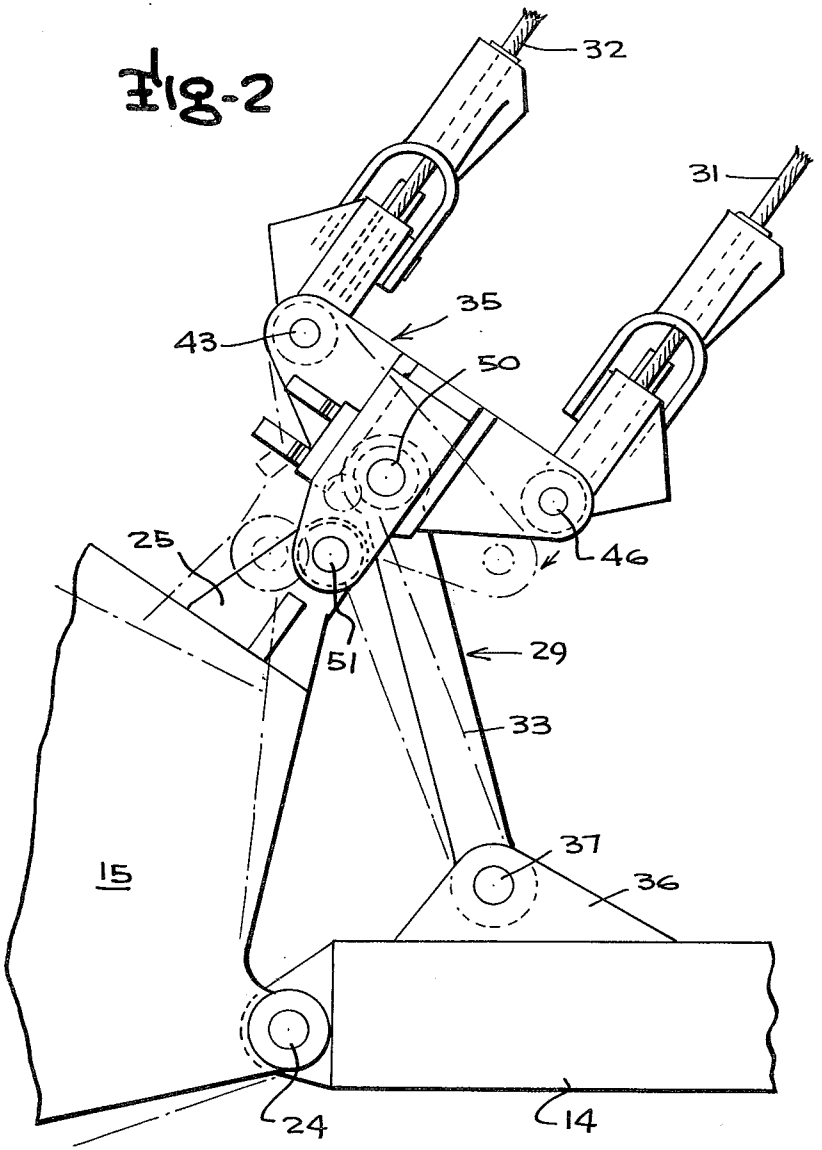
FIG. 2 is an enlarged fragmentary view of the power shovel shown in FIG. 1, illustrating a portion of the embodiment of the invention in greater detail.

The hoist system 16 generally includes a linkage 29 operatively interconnecting the dipper handle and dipper, a hoist assembly 30 mounted on the main frame 11 within the cab 12, and a pair of hoist lines 31 and 32 operatively interconnecting the hoist mechanism 30 and the linkage 29. As best illustrated in FIGS. 2 through 4, the linkage 29 consists of a pair of rigid links 33 and 34 and a bell crank 35. Rigid links 33 and 34 are pivotally connected at one set of ends thereof to a pair of brackets 36 provided on the upper front end of dipper handle 14 by means of connecting pins 37.

Bell crank 35 is either of a welded or cast construction and includes an upper wall member 38 and depending front and rear wall members 39 and 40 having side edges terminating inwardly from the side edges of upper wall member 38. Mounted on the outer face of front wall member 39 and projecting forwardly thereof is a pair of arm members 41 and 42 having a pair of transversely aligned openings 41*a* and 42*a* for receiving a connecting pin 43 therein. Similarly mounted on the outer face of rear wall member 40 and projecting rearwardly therefrom in alignment with arm members 41 and 42 is a pair of arm members 44 and 45 having a pair of transversely aligned openings 44*a* and 45*a* for receiving and supporting a connecting pin 46 therein.

Depending from the upper wall member 38 and disposed between the ends of front and rear wall members 39 and 40 is a pair of downwardly projecting arm members 46 and 47. Similarly depending from upper wall member 38 and spaced outwardly from arm members 46 and 47 is a second pair of downwardly projecting arm members 48 and 49. The depending arm members 46 through 49 are provided with an upper set of transversely aligned openings 46*a*, 47*a*, 48*a* and 49*a* for receiving and supporting a pair of connecting pins 50, and a lower set of transversely aligned openings 46*b*, 47*b*, 48*b* and 49*b* for receiving and supporting a pair of connecting pins 51. Preferably, the axes of all the aforementioned pin supporting openings are parallel, and the axes of the pin supporting openings in depending members 46 through 49 lie in a common plane disposed perpendicular to a common plane including the pin supporting openings of arm members 41, 42, 44 and 45. The bell crank 35 further is reenforced by a pair of plate members 52 and 53 secured to the front face of front wall member 39 and the front edges of depending arm members 48 and 49, and gusset plates 54 welded to the front faces of plate members 52 and 53 and forwardly projecting arm members 41 and 42.

As shown in FIG. 2, the bell crank 35 is pivotally connected to support links 33 and 34 by means of connecting pins 50, and pivotally connected to the dipper by means of connecting pins 51.

Figure 5:
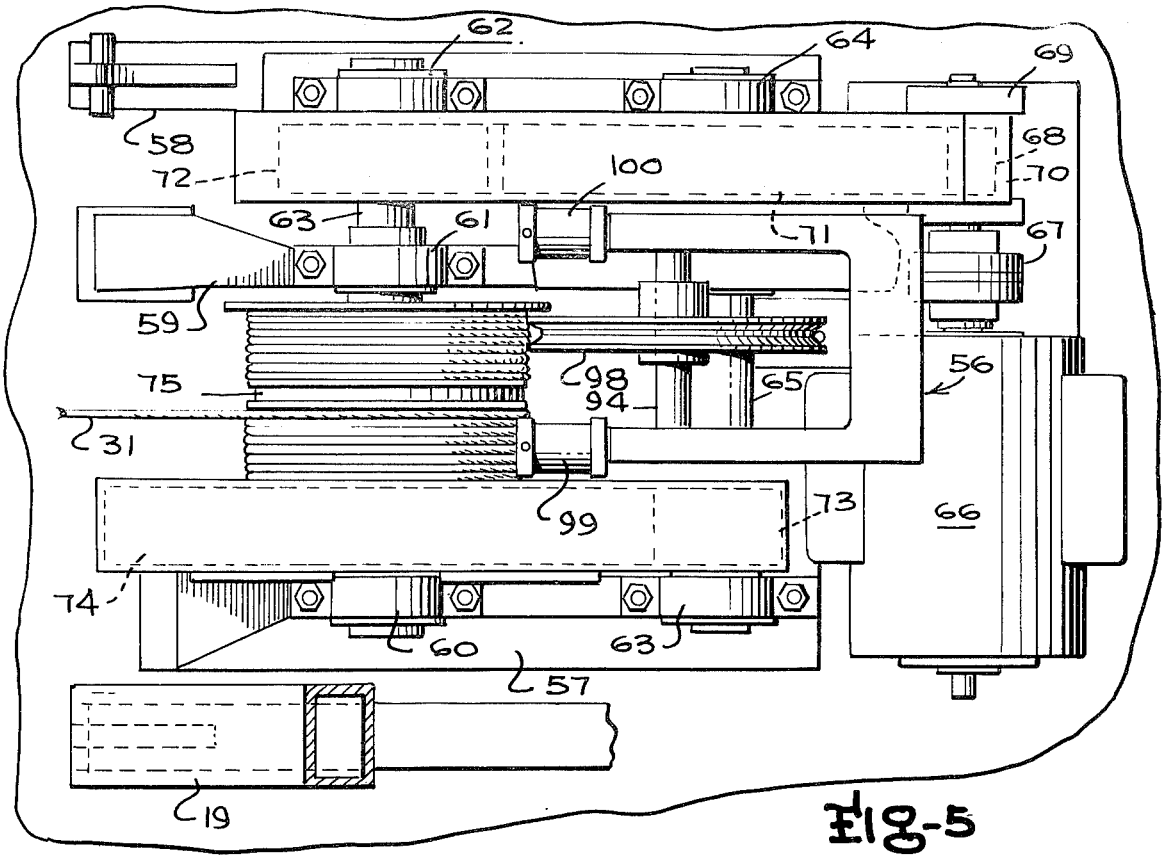
FIG. 5 is a top plan view of another assembly of the embodiment of the invention shown in FIG. 1.
Figure 6:
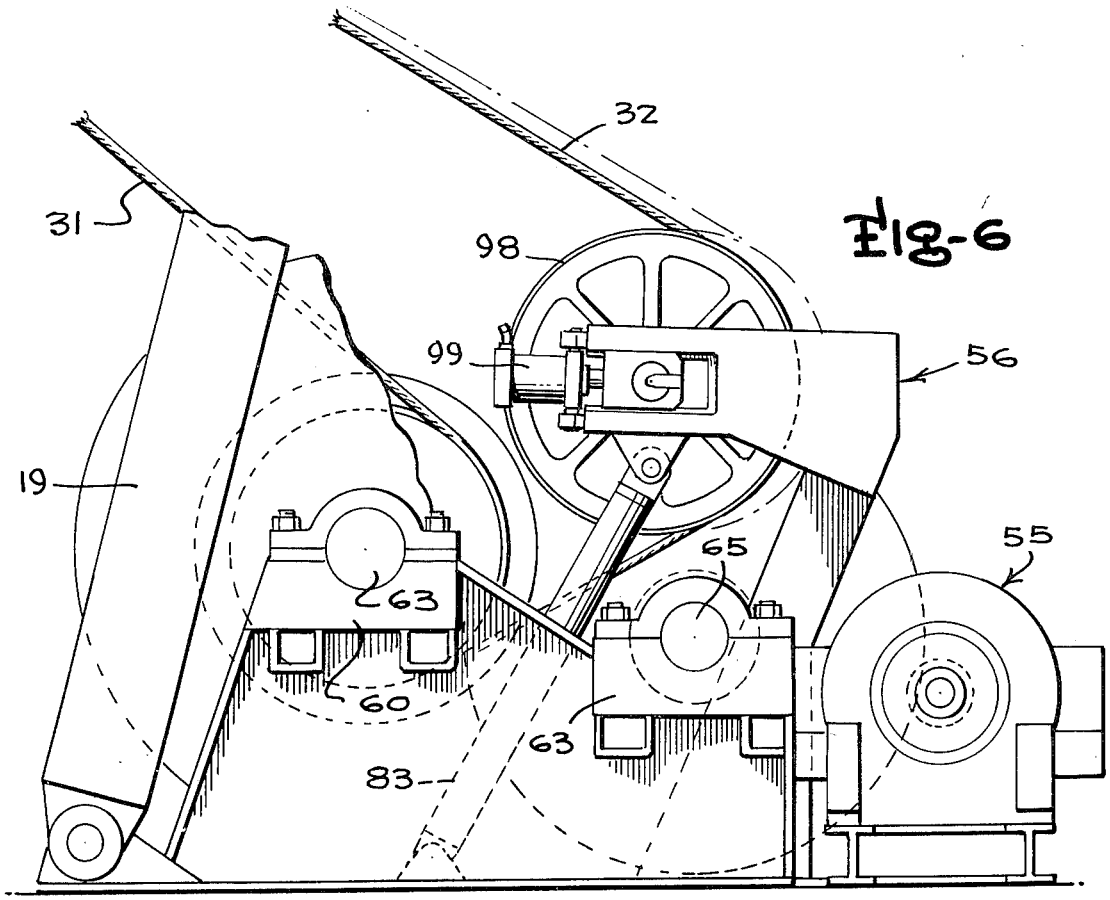
FIG. 6 is a side elevational view of the assembly illustrated in FIG. 5.
Figure 7:
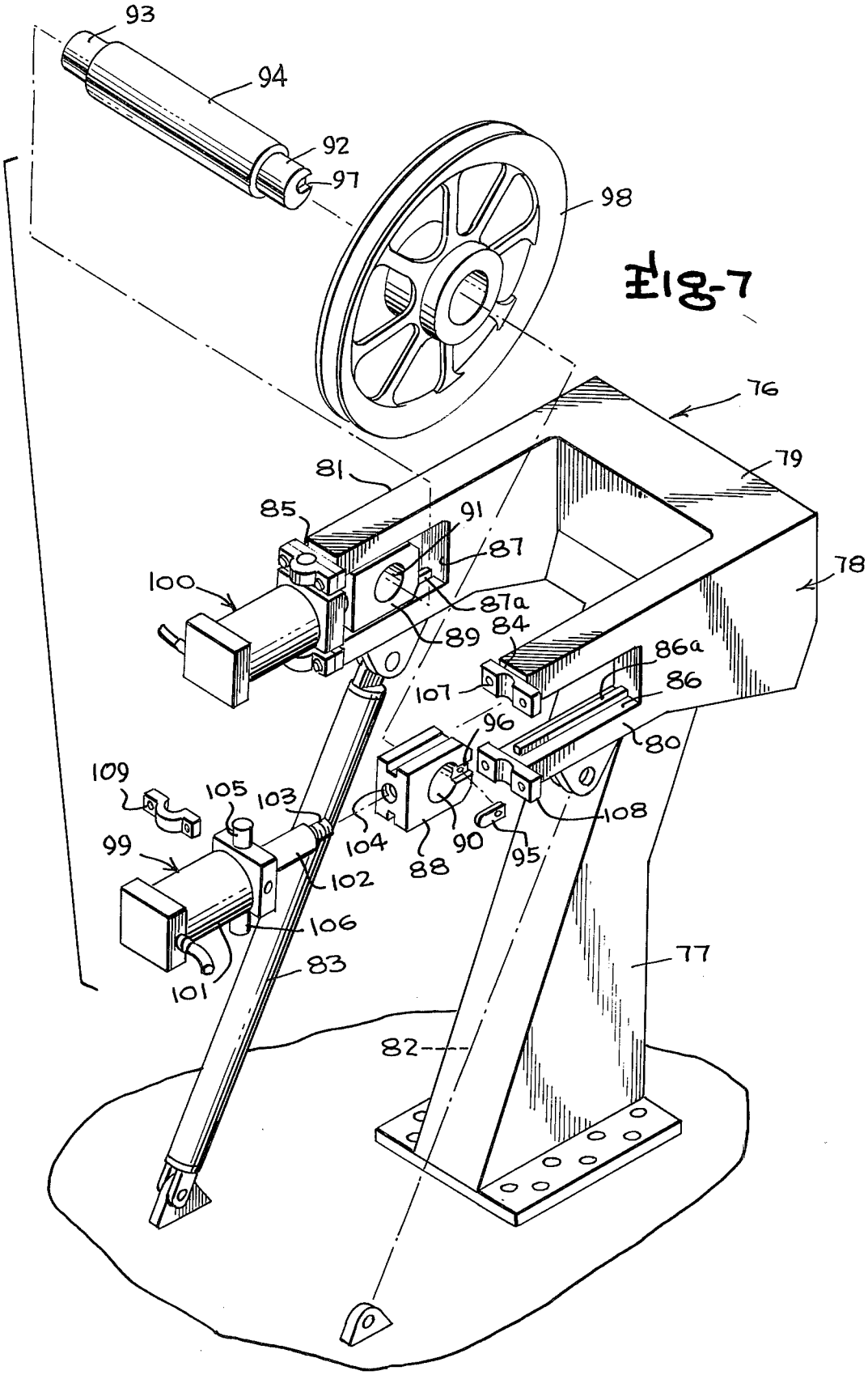
FIG. 7 is an enlarged perspective view of the assembly shown in FIG. 6, illustrating the components thereof in exploded relation.

FIGS. 5 through 7 best illustrate the hoist assembly which consists of a hoist mechanism 55 and a pitch control mechanism 56. The hoist mechanism 55 includes a pair of longitudinally disposed, transversely spaced pedestals 57 and 58, and a longitudinally disposed, intermediate pedestal 59 spaced between pedestals 57 and 58. Mounted on the pedestals 57, 58 and 59 is a set of forwardly disposed bearings 60, 61 and 62 in which there is journaled a hoist drum shaft 63. Also mounted on the pedestals 57 and 58 is a pair of rearwardly disposed bearings 63 and 64 in which there is journaled an intermediate hoist shaft 65.

Disposed rearwardly of pedestals 57, 58 and 59 is a hoist motor 66 having a drive shaft connected by a coupling 67 to a shaft 68 journaled in a bearing 69 supported on a pedestal. Drive is transmitted from the shaft 68 to the hoist drum shaft 63 by means of a gear train consisting of a gear 70 mounted on shaft 68, a gear 71 mounted on the intermediate hoist shaft 65 and meshing with gear 70, a gear 72 mounted on the hoist drum shaft 63 and meshing with gear 71, intermediate hoist shaft 65, a gear 73 mounted on intermediate hoist shaft 65 and gear 74 mounted on hoist drum shaft 63 and meshing with gear 73. As best illustrated in FIG. 5, a hoist drum 75 is mounted on hoist drum shaft 63. The hoist mechanism as described is substantially conventional in construction and operation. Such a mechanism further would be provided with suitable brake, clutch and similar control components to pay out and take in hoist line in the conventional manner.

Control mechanism 56 is best illustrated in FIG. 7 and includes a pedestal 76 having a vertical section 77 secured at its lower end to the deck between the shaft supporting pedestals 57 and 58, and a horizontal upper section 78 including a rearwardly disposed, transverse portion 79 and a pair of forwardly projecting, transversely spaced arm portions 80 and 81. It will be noted from FIGS. 5 through 7 that the horizontal pedestal section 78 is disposed above the axis of hoist drum shaft 63 and provides a recess having a longitudinal center line offset laterally relative to the longitudinal center line of hoist drum 75. The arm portions 88 and 89 are supported at their forwardly disposed ends by means of a pair of braces 82 and 83 which are secured at their lower ends to the deck.

The front faces 84 and 85 of arm portions 80 and 81 are recessed to provide a pair of longitudinally disposed, transversely aligned guide channels 86 and 87 provided with longitudinally disposed guide ridges 86*a* and 87*a*. Slidably disposed in the guide channels 86 and 87 are journal blocks 88 and 89 provided with longitudinal grooves in the upper and lower surfaces thereof which are adapted to receive guide ridges 86*a* and 87*a*. Journal blocks 88 and 89 further are provided with transverse bores 90 and 91 in which there is received and supported the reduced ends 92 and 93 of a floater sheave shaft 94. The shaft 94 is retained within the journal blocks and prevented from rotating by means of lock elements 95 each of which is secured to a journal block within a slot 96 and projects into a recess 97 provided on an end of the shaft 94. A floating sheave 98 is rotatably mounted on the shaft 94 and is adapted to move with the shaft 74 and journal blocks 88 and 89 along a longitudinal line of travel.

Journal blocks 88 and 89 are moved along the guide channels by means of fluid actuated assemblies 99 and 100 which are substantially similar in construction and operation. Fluid actuated assembly 99 consists of a cylinder 101 and a ram 102 having a threaded portion 103 which is threaded into a threaded opening 104 in the front face of journal block 88. The assembly 99 is detachably mounted on the front end of arm portion 80 by means of a pair of vertically aligned stub shafts 105 and 106 which are seated on a pair of seating members 107 and 108 rigidly secured to front face 84, above and below guide channel 86, and a pair of retainer members 109 which engage stub shafts 105 and 106 and are detachably secured to seating members 107 and 108, preferably by threaded fasteners.

The opposite ends of the cylinders of fluid actuated assemblies 99 and 100 are connected to a suitable circuit with appropriate controls so that fluid under pressure may be applied simultaneously to the front or rear ends of the cylinders of the assemblies to extend or retract the rams thereof and, correspondingly, to adjust the positions of journal blocks 88 and 89 within guide channels 86 and 87. It further will be appreciated that by adjusting the journal blocks longitudinally within the guide channels, the axis of floating sheave 98 will be displaced longitudinally.

Referring to FIGS. 1 through 6, hoist line 31 is operatively connected at one end to hoist drum 75, extends upwardly and is reeved about a boom point sheave 20, and is secured to arm members 44 and 45 of bell crank 35 by means of connecting pin 46. Hoist line 32 is operatively connected at one end to hoist drum 75, extends rearwardly and is reeved about floating sheave 98, extends forwardly and is reeved about a boom point sheave 20 and is connected at its opposite end to arm members 41 and 42 of bell crank 35 by means of connecting pin 43. As best illustrated in FIG. 5, it will be noted that the offset of the longitudinal center lines of the recess formed in horizontal pedestal section 79 and the longitudinal center line of hoist drum 75 permits the floating sheave 98 to slide transversely on shaft 94 within predetermined limits to guide hoist line 32 onto one end of hoist drum 75 thus preventing interference with the winding and unwinding of hoist line 31.

While the dipper is at rest or moving through a digging cycle, the pitch thereof may be adjusted merely by supplying fluid under pressure selectively to the front or rear ends of the cylinders of fluid actuated assemblies 99 and 100 to displace the axis of floating sheave 98 longitudinally relative to the axis of hoist drum shaft 63. The effect of such displacement will be to alter the effective length of hoist line 32 relative to hoist line 31 so that bell crank 35 will be caused to pivot about pin 50. The pivotal action of bell crank 35 correspondingly will pivot dipper 15 about its pivotal connection with dipper handle 14 through connecting pin 51. Accordingly, any longitudinal adjustment of floating sheave 98 will result in a pitch change of the dipper.

In the operation of the power shovel as described to effect a maximum horizontal crowding action of the dipper and an upward pitch of the dipper at the end of the crowding movement thereof, deposit a maximum amount of material excavated in the dipper and retain such material in the dipper as it is hoisted and swung to a dump position, initially, the crowd machinery of the shovel is operated to retract the dipper handle and the hoist lines are permitted to be payed out so that the dipper is positioned adjacent the lower end of the boom as illustrated by the broken lines in FIG. 1, designated by the reference letter A. Pitch control mechanism 56 then is operated to position the dipper at the desired pitch. The crowd machinery and hoist mechanism next is operated to crowd the dipper handle while taking up on the hoist line thus crowding the dipper into the material being excavated. While the dipper is being crowded, the control mechanism 56 can be operated to control the pitch of the dipper. During such phase of the digging cycle, it is desirable to maintain the dipper horizontal as illustrated by the broken lines designated by the reference letter B in FIG. 1 thus permitting the stripping of a thin seam material. At the end of the crowding phase of the cycle, the pitch control mechanism can be operated to pitch the dipper upwardly as illustrated by the broken lines designated by the reference letter C in FIG. 1 thereby assuring a maximum fill of the dipper as the hoist mechanism continues to hoist the dipper to an elevated position as illustrated by the solid lines in FIG. 1. The boom then may be swung to a dump position by operating appropriate machinery on the shovel. In doing so, the pitch control mechanism 56 may be operated to pitch the dipper upwardly to a dump position as illustrated by the solid lines in FIG. 1.

Such attitude of the dipper facilitates dumping which is accomplished merely by releasing the latch of hinged dipper door 28. The crowd machinery and hoist mechanism then may be operated again to retract the dipper handle and position the dipper adjacent the lower end of the boom with the dipper pitched at the desired angle to begin another digging cycle.

It will be appreciated that the pitch control mechanism of the hoist system may be operated at any time while the dipper is at rest or moving through a digging cycle to adjust the pitch of the dipper without interfering with the movements of any other components of the shovel. This particularly is advantageous in that whenever the dipper encounters resistance during crowding, the pitch of the dipper may be adjusted to facilitate the penetration of the dipper into the material being excavated. It further will be noted that such pitch change is accomplished merely with the addition of comparatively few components mounted on the outer end of the dipper handle, i.e., support links 33 and 34 and bell crank 35, which are comparatively invulnerable to damage thus enhancing the reliability of the system, and sufficiently lightweight so as not to penalize the payload of the shovel.

The combination of linkage 29, the dipper handle and dipper provides a four-bar linkage including a portion of the dipper handle disposed between connecting pins 37 and 24, a portion of the dipper disposed between connecting pins 24 and 51, a portion of the bell crank disposed between connecting pins 51 and 50, and rigid support links 33 and 34. It thus will be seen that the operation of the pitch control mechanism on the deck of the shovel functions to vary the effective length of one of the hoist lines relative to the other hoist line which correspondingly alters the angular relationship of the four-bar linkage to provide the desired pitch adjustment of the dipper.

Although in the embodiment as described, the hoist lines are indicated as being connected to one of the members of the four-bar linkage, i.e., bell crank 35, at points disposed on opposite sides of a line disposed tangentially relative to the boom point sheaves 20 and passing through the axis of connecting pin 50 whereupon displacement of one of the hoist lines relative to the other results in pivotal movement of the bell crank 35 relative to support links 33 and 34 to provide the desired pitch adjustment, it is contemplated that other connections of the hoist lines to the four-bar linkage will produce the same pitch adjustment within the scope of the invention. Considering such a four-bar linkage includes a rigid support link pivotally connected to the dipper handle and a pivot link pivotally connected to the dipper and pivotally connected at a point spaced from the pivotal connection thereof with the dipper, to the support link, other possible combinations would include (a) connecting both hoist lines to the support link which would function as a bell crank, (b) connecting one of the hoist lines to the support link and the other hoist line to the pivot link, (c) connecting one of the hoist lines to one of the support or pivot links and the other to one of the dipper handle or dipper, and (d) connecting one of the hoist lines to the pivotal connection between the support and pivot links and the other to one of the dipper handle or dipper.

Furthermore, it is contemplated that one of the hoist lines may be connected directly to the dipper handle and the other to the dipper whereby the segments of the hoist lines extending from the boom point sheave to the dipper handle and dipper would comprise members of a four-bar linkage, and the variation of length of one of the hoist lines would result in a change of the angular relationship of the four-bar linkage thereby providing the desired pitch adjustment of the dipper. A still further arrangement contemplated within the scope of the invention would provide connecting the hoist lines to the dipper on opposite sides of the pivotal connection of the dipper to the handle to provide a three bar linkage. In such an arrangement variations in the length of one of the hoist lines relative to the other would alter the angular relationship of the four-bar linkage thus correspondingly varying the pitch of the dipper.

Another contemplated arrangement would involve connecting a reference hoist line and a pitch adjusting hoist line to the dipper at predetermined points so that the sum of the moments about the connection of the reference hoist line with the dipper is zero, and maintaining both of such hoist lines in tension under all operating conditions of the system. In such an arrangement, the operation of the hoist machinery would function to hoist and lower the dipper and dipper handle in the conventional manner, and simultaneously or independently imposed variations of the effective length of the pitch adjusting hoist line relative to the reference hoist line would operate to adjust the pitch of the dipper.

From the foregoing detailed description, it will be evident that there are a number of changes, adaptations and modifications of the present invention which will come within the province of those persons having ordinary skill in the art. However, it is intended that all such variations not departing from the spirit of the invention be considered as within the scope thereof as limited solely by the appended claims.

We claim:

1. In a power shovel having a main frame, a boom connected at a lower end thereof to said main frame, a dipper handle pivotally connected to said boom and a dipper pivotally connected to said dipper handle, a hoist system for said dipper including means for varying the pitch thereof comprising a common hoist drum mounted on said main frame, a first hoist line operatively connected at one end thereof to said hoist drum, passing over a point on said boom and operatively connected at the opposite end thereof to said dipper handle, a second hoist line operatively connected at one end thereof to said hoist drum, passing over a point on said boom and operatively connected at the opposite end thereof to said dipper, and means for selectively displacing one of said hoist lines relative to the other thereof.

2. A hoist system according to claim 1 wherein said means for selectively displacing one of said hoist lines relative to the other thereof is operable for selectively displacing said second hoist line relative to said first hoist line.

3. A hoist system according to claim 1 wherein said hoist lines are reeved about sheaves mounted on the outer end of said boom.

4. A hoist system according to claim 2 wherein said means for selectively displacing said second hoist line relative to said first hoist line comprises a floating sheave about which said second hoist line is reeved and means for moving said floating sheave along a line of travel intersecting said second hoist line.

5. A hoist system according to claim 4 wherein said means for moving said floating sheave along a line of travel intersecting said second hoist line comprises a pair of fluid actuated assemblies including cylinders rigidly mounted on said main frame and movable rams operatively connected to a shaft on which said floating sheave is mounted.

6. A hoist system according to claim 2 wherein said means for selectively displacing said second hoist line relative to said first hoist line comprises a support frame mounted on said main frame, said support frame having a pair of spaced guide channels disposed in a plane intersecting said second hoist line, journal blocks movably mounted in said guide channels, a shaft journaled in said guide blocks and movable therewith along said guide channels, a floating sheave mounted on said shaft, about which said second hoist line is reeved, a pair of fluid actuated assemblies, each including a cylinder mounted on said support frame and a ram operatively connected to one of said journal blocks whereby upon applying fluid under pressure selectively to opposite ends of said cylinders, said rams will be caused to extend and retract and, correspondingly, move said floating sheave along the line of travel intersecting said second hoist line, and control means for selectively supplying fluid under pressure to opposite ends of said cylinders.

7. A hoist system according to claim 1 wherein said first hoist line is connected directly to said dipper handle and said second hoist line is connected directly to said dipper.

8. A hoist system according to claim 1 including a support link pivotally connected to said dipper handle and a pivot link pivotally connected to said dipper and pivotally connected to said support link at a point spaced from the pivotal connection thereof with said dipper to form a four-bar linkage including a portion of said dipper handle, a portion of said dipper and said support and pivot links, wherein each of said first and second hoist lines is connected directly to one of said dipper handle, dipper and support and pivot links.

9. A hoist system according to claim 8 wherein said first hoist line is connected to said pivot link and said second hoist line is connected to said dipper.

10. A hoist system according to claim 8 wherein said first hoist line is connected to said support link and said second hoist line is connected to said dipper.

11. A hoist system according to claim 8 wherein said first hoist line is connected to the pivotal connection of said support and pivot links and said second hoist line is connected to said dipper.

12. A hoist system according to claim 8 wherein said first hoist line is connected to said dipper handle, said second hoist line is connected to said pivot link, and said means for selectively varying the effective length of one of said hoist lines relative to the other thereof is operable for selectively varying the effective length of said second hoist line relative to said first hoist line.

13. A hoist system according to claim 8 wherein said first hoist line is connected to said dipper handle, said second hoist line is connected to said support link and said means for selectively displacing one of said hoist lines relative to the other thereof is operable for selectively displacing said second hoist line relative to said first hoist line.

14. A hoist system according to claim 8 wherein said first hoist line is connected to said dipper handle, said second hoist line is connected to the pivotal connection of said support and pivot links, and said means for selectively displacing one of said hoist lines relative to the other thereof is operable for selectively displacing said second hoist line relative to said first hoist line.

15. A hoist system according to claim 8 wherein said first hoist line is connected to said support link and said second hoist line is connected to said pivot link.

16. In a power shovel having a main frame, a boom connected at a lower end thereof to said main frame, a dipper handle pivotally connected to said boom and a dipper pivotally connected to said dipper handle, a hoist system for said dipper including means for varying the pitch thereof comprising a support link pivotally connected to said dipper handle, a second link pivotally connected to said dipper and pivotally connected to said support link at a point spaced from the pivotal connection thereof with said dipper to form a four-bar linkage including a portion of said dipper handle, a portion of said dipper and said support and pivot links, a hoist drum mounted on said main frame, a first hoist line operatively connected at one end to said hoist drum, passing over a point on said boom and connected at the opposite end thereof to one of said support and pivot links, a second hoist line operatively connected at one end thereof to said hoist drum, passing over a point of said boom and connected at the opposite end thereof to one of said support and pivot links, and means for selectively displacing one of said hoist lines relative to the other thereof.

17. A hoist system according to claim 16 wherein the connections of said hoist lines to said four-bar linkage are disposed on opposite sides of a line intersecting said point on said boom and the pivotal connection between said support and pivot links.

18. A hoist system according to claim 16 wherein said hoist lines are reeved about sheaves mounted on the outer end of said boom.

19. A hoist system according to claim 18 wherein the connections of said hoist lines to said four-bar linkage are disposed on opposite sides of a line disposed tangentially relative to said sheaves mounted on the outer end of said boom, and passing through the pivotal connection between said support and pivot links.

20. A hoist system according to claim 16 wherein each of said hoist lines is connected to said support link.

21. A hoist system according to claim 16 wherein each of said hoist lines is connected to said pivot link.

22. A hoist system according to claim 21 wherein the connections of said hoist lines to said pivot link are disposed on opposite sides of a line passing through said point on said boom and the pivotal connection between said support and pivot links.

23. A hoist system according to claim 21 wherein said hoist lines are reeved about sheaves mounted on the outer end of said boom.

24. A hoist system according to claim 23 wherein the connections of said hoist lines to said pivot link are disposed on opposite sides of a line disposed tangentially relative to said sheaves mounted on the outer end of said boom, and passing through the pivotal connection between said support and pivot links.

25. A hoist system according to claim 16 wherein said means for selectively displacing said hoist lines relative to the other thereof comprises a floating sheave about which said one of said hoist lines is reeved and means for moving said floating sheave along a line of travel intersecting said one of said hoist lines.

26. A hoist system according to claim 25 wherein said means for moving said floating sheave along a line of travel intersecting said one of said hoist lines comprises a pair of fluid actuated assemblies including cylinders rigidly mounted on said main frame and movable rams operatively connected to a shaft on which said floating sheave is mounted.

27. A hoist system according to claim 16 wherein said means for selectively displacing one of said hoist lines relative to the other thereof comprises a support frame mounted on said main frame, said support frame having a pair of spaced guide channels disposed in a plane intersecting said one of said hoist lines, journal blocks movably mounted in said guide channels, a shaft journaled in said guide blocks and movable therewith along said guide channels, a floating sheave mounted on said shaft, about which said one of said hoist lines is reeved, a pair of fluid actuated assemblies, each including a cylinder mounted on said support frame and a ram operatively connected to one of said journal blocks whereby upon applying fluid under pressure selectively to opposite ends of said cylinders, said rams will be caused to extend and retract and, correspondingly, move said floating sheave along the line of travel intersecting said one of said hoist lines, and control means for selectively supplying fluid under pressure to opposite ends of said cylinders.

28. A power shovel having a main frame, a boom connected at the lower end thereof to said main frame, a dipper handle pivotally connected to said boom and a dipper pivotally connected to said dipper handle, a hoist system for said dipper including means for varying the pitch thereof comprising a common hoist drum mounted on said main frame, first and second hoist lines operatively connected at one set of ends thereof to said hoist drum, passing over a point on said boom and operatively connected at the opposite set of ends thereof to said dipper, and means for selectively displacing one of said hoist lines relative to the other thereof.

29. In a power shovel having a main frame, a boom connected at a lower end thereof to said main frame, a dipper handle pivotally connected to said boom and a dipper pivotally connected to said dipper handle, a hoist system for said dipper including means for varying the pitch thereof comprising a support link pivotally connected to said dipper handle, a pivot link pivotally connected to said dipper and pivotally connected to said support link at a point spaced from the pivotal connection thereof with said dipper to form a four-bar linkage including a portion of said dipper handle, a portion of said dipper and said support and pivot links, a common hoist drum mounted on said main frame, a first hoist line operatively connected at one end to said hoist drum, passing over a point on said boom and connected at the opposite end thereof to the pivotal connection between said support and pivot links, a second hoist line operatively connected at one end thereof to said hoist drum, passing over a point of said boom and connected at the opposite end thereof to one of said dipper handle, dipper and support and pivot links, and means for selectively displacing one of said hoist lines relative to the other thereof.

30. A hoist system according to claim 29 wherein said hoist lines are reeved about sheaves mounted on the outer end of said boom.

* * * * *